US011219301B2

(12) United States Patent
Hohlbein

(10) Patent No.: US 11,219,301 B2
(45) Date of Patent: Jan. 11, 2022

(54) ORAL CARE IMPLEMENT

(71) Applicant: Colgate-Palmolive Company, New York, NY (US)

(72) Inventor: Douglas Hohlbein, Hopewell, NJ (US)

(73) Assignee: Colgate-Palmolive Company, New York, NY (US)

( * ) Notice: Subject to any disclaimer, the term of this patent is extended or adjusted under 35 U.S.C. 154(b) by 89 days.

(21) Appl. No.: 16/217,773

(22) Filed: Dec. 12, 2018

(65) Prior Publication Data

US 2019/0110585 A1 Apr. 18, 2019

Related U.S. Application Data

(63) Continuation of application No. 14/653,869, filed as application No. PCT/US2012/070760 on Dec. 20, 2012, now Pat. No. 10,178,907.

(51) Int. Cl.

| | |
|---|---|
| ***A46B 9/04*** | (2006.01) |
| ***A46B 9/02*** | (2006.01) |
| *A46B 15/00* | (2006.01) |
| *A46B 3/06* | (2006.01) |
| *A46B 9/06* | (2006.01) |

(52) U.S. Cl.

CPC ..... *A46B 9/04* (2013.01); *A46B 9/025* (2013.01); *A46B 3/06* (2013.01); *A46B 9/06* (2013.01); *A46B 15/0081* (2013.01); *A46B 2200/1066* (2013.01)

(58) Field of Classification Search

CPC ..... A46B 9/04; A46B 9/025; A61C 17/3436; A61C 17/26

See application file for complete search history.

(56) References Cited

U.S. PATENT DOCUMENTS

| | | | | |
|---|---|---|---|---|
| 1,897,365 A | | 2/1933 | Duey | |
| 1,901,230 A | * | 3/1933 | Duey | A46B 9/04 15/167.1 |
| 2,161,349 A | * | 6/1939 | Hadden | A46B 9/04 15/167.1 |

(Continued)

FOREIGN PATENT DOCUMENTS

| | | |
|---|---|---|
| CH | 215110 | 9/1941 |
| CN | 102740730 | 10/2012 |

(Continued)

OTHER PUBLICATIONS

Computer generated English translation of DE 20213325 U1, Rueb Holding GmbH, published Oct. 17, 2002. (Year: 2002).*

(Continued)

*Primary Examiner* — Laura C Guidotti

(57) ABSTRACT

An oral care implement is described. The oral care implement may include a head extending along a longitudinal axis and having a first surface, a second surface opposite the first surface, and a side surface extending between the first surface and the second surface. A central bristle tuft may from a central portion of the first surface. A plurality of perimetric bristle tufts may from the first surface and arranged to circumferentially surround the central bristle tuft. The perimetric bristle tufts may have distal ends that slope downwardly towards the central bristle tuft. The perimetric bristle tufts may be wedge shaped.

19 Claims, 4 Drawing Sheets

(56) References Cited

U.S. PATENT DOCUMENTS

| | | | | |
|---|---|---|---|---|
| 2,303,667 | A | 12/1942 | Taborski | |
| 2,305,461 | A | 12/1942 | Spyra | |
| 4,268,933 | A | 5/1981 | Papas | |
| 5,144,712 | A | 9/1992 | Hansel et al. | |
| 5,535,474 | A | 7/1996 | Salazar | |
| 6,108,849 | A | 8/2000 | Weihrauch | |
| 6,490,747 | B1 | 12/2002 | Metwally | |
| 7,143,462 | B2 | 12/2006 | Hohlbein | |
| 7,788,756 | B2 * | 9/2010 | Kraemer | A46B 9/025 15/22.1 |
| 7,941,886 | B2 * | 5/2011 | Chenvainu | A46B 9/005 15/22.4 |
| 7,954,191 | B2 | 6/2011 | Hohlbein | |
| 8,398,326 | B2 | 3/2013 | Jimenez et al. | |
| 2010/0024142 | A1 | 2/2010 | Townley | |
| 2010/0088836 | A1 | 4/2010 | Kirchhofer et al. | |
| 2011/0030160 | A1 | 2/2011 | Knutzen et al. | |
| 2011/0047736 | A1 * | 3/2011 | Jimenez | A46B 9/04 15/167.2 |
| 2011/0072604 | A1 | 3/2011 | Alvarenga | |
| 2011/0109149 | A1 | 5/2011 | Loetscher et al. | |
| 2011/0203066 | A1 | 8/2011 | Hahn | |
| 2012/0204371 | A1 * | 8/2012 | Chun | A46B 9/028 15/167.1 |

FOREIGN PATENT DOCUMENTS

| | | | | |
|---|---|---|---|---|
| DE | 4010671 | A1 * | 8/1990 | A46B 9/04 |
| DE | 20213325 | U1 * | 10/2002 | A46B 13/008 |
| DE | 202008004017 | U1 * | 7/2008 | A46B 9/04 |
| DE | 102009009034 | | 8/2010 | |
| GB | 430329 | A | 6/1935 | |
| GB | 490892 | | 8/1938 | |
| GB | 2085717 | B | 5/1982 | |
| JP | 09-313255 | | 12/1997 | |
| JP | 2002-345555 | | 12/2002 | |
| JP | 2005-245719 | | 9/2005 | |
| KR | 2017003695 | U * | 10/2017 | A46B 9/04 |
| WO | WO2008098721 | | 8/2008 | |
| WO | WO2009146909 | | 12/2009 | |

OTHER PUBLICATIONS

Computer generated English translation of DE 4010671 A1, Vukosavljevic, Aug. 1990. (Year: 1990).*

Computer generated English translation of DE 202008004017 U1, Hausler, Jul. 2008. (Year: 2008).*

Corresponding Chinese Search Report dated Apr. 25, 2016.

Corresponding Chinese Office Action dated May 5, 2016.

International Search Report and the Written Opinion of the International Searching Authority issued in International Patent Application PCT/US2012/070760 dated Oct. 14, 2013.

Written Opinion of the International Preliminary Examining Authority issued in International Patent Applicaton PCT/US2012/070760 dated Mar. 9, 2015.

* cited by examiner

ORAL CARE IMPLEMENT

CROSS-REFERENCE TO RELATED APPLICATIONS

The present application is a continuation of U.S. patent application Ser. No. 14/653,869, filed Jun. 19, 2015, which is a U.S. national stage application under 35 U.S.C. § 371 of PCT Application No. PCT/US2012/070760, filed Dec. 20, 2012, the entireties of which are incorporated herein by reference.

BACKGROUND

Oral care implements, especially toothbrushes, are used by many people on a daily basis. Typical oral care implements comprise an elongate handle and a head connected to one end of the handle. The handle provides a structure by which a user grips and manipulates the oral care implement during use. The head typically comprises one or more elements designed to perform their intended function, such as tooth cleaning elements, soft tissue cleaning elements, and/or oral care agents.

Toothbrushes are oral care implements having one or more tooth cleaning elements, which are used to clean teeth by removing plaque and debris from surfaces of the teeth. Conventional toothbrushes are limited in their ability to retain dentifrice for cleaning teeth. During an oral care session, the dentifrice typically slips through the tooth cleaning elements, such as tufts of bristles, and away from the contact zone of the cleaning elements with the teeth. As a result, the dentifrice often is spread around the mouth, rather than being concentrated on the contact zone. Therefore, the efficiency of the cleaning process is reduced.

Over the years, efforts have been made to improve the design of oral care implements, in order that they may deliver improved cleaning of users' oral cavities during oral care sessions. Such efforts have included the development of heads carrying structures intended to better retain dentifrice for use in cleaning and/or polishing teeth. Despite these efforts, a need still exists for an oral care implement with a head having a structure for better retaining dentifrice, to enable improved cleaning and/or polishing of a user's teeth. A need also exists for an oral care implement that is easier to clean after an oral care session.

BRIEF SUMMARY

An oral care implement is described. The oral care implement may include a head extending along a longitudinal axis and having a first surface, a second surface opposite the first surface, and a side surface extending between the first surface and the second surface. A central bristle tuft may from a central portion of the first surface. A plurality of perimetric bristle tufts may from the first surface and arranged to circumferentially surround the central bristle tuft. The perimetric bristle tufts may have distal ends that slope downwardly towards the central bristle tuft. The perimetric bristle tufts may be wedge shaped.

In one aspect, the invention may be oral care implement comprising: a head extending along a longitudinal axis and having a first surface, a second surface opposite the first surface, and a side surface extending between the first surface and the second surface; a central bristle tuft extending from a central portion of the first surface; and a plurality of perimetric bristle tufts extending from the first surface and arranged to circumferentially surround the central bristle tuft.

In another aspect, the invention may be an oral care implement comprising: a head extending along a longitudinal axis, the head having a substantially elliptical outer shape in plan view; a central bristle tuft extending from a central portion of a first surface of the head, the central bristle tuft having a substantially elliptical outer shape in plan view with a major axis that is located on the longitudinal axis of the head; a plurality of wedge-shaped perimetric bristle tufts extending from the first surface of the head and arranged to circumferentially surround the central bristle tuft, wherein each of the perimetric bristle tufts comprises an inner sidewall that is immediately adjacent the central bristle tuft and an outer sidewall opposite the inner sidewall that immediately adjacent an outer perimeter of the first surface of the head, the outer sidewall having a width that is greater than a width of the inner sidewall; and wherein each of the plurality of perimetric bristle tufts comprises an inclined distal surface that slopes downward toward the central bristle tuft.

In yet another aspect, the invention may be an oral care implement, comprising: a head comprising a head portion and a head plate that is coupled to the head portion, the head plate having a first surface, a second surface opposite the first surface, and a plurality of tuft holes extending through the head plate; and a bristle tuft comprising a first portion that extends from the first surface of the head plate, a second portion that extends from the second surface of the head plate, and a third portion that is located within one of the tuft holes, the second portion being melted to form a melt matte to couple the bristle tuft to the head plate; wherein the bristle tuft comprises a plurality of bristles that form a continuous wall that is free of gaps, the continuous wall surrounding a cavity that having a frusto-conical shape.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

A more complete understanding of the present invention, and the advantages thereof, may be acquired by referring to the following description in consideration of the accompanying drawings, in which like reference numbers indicate like features, and wherein.

DETAILED DESCRIPTION

Figure 1:
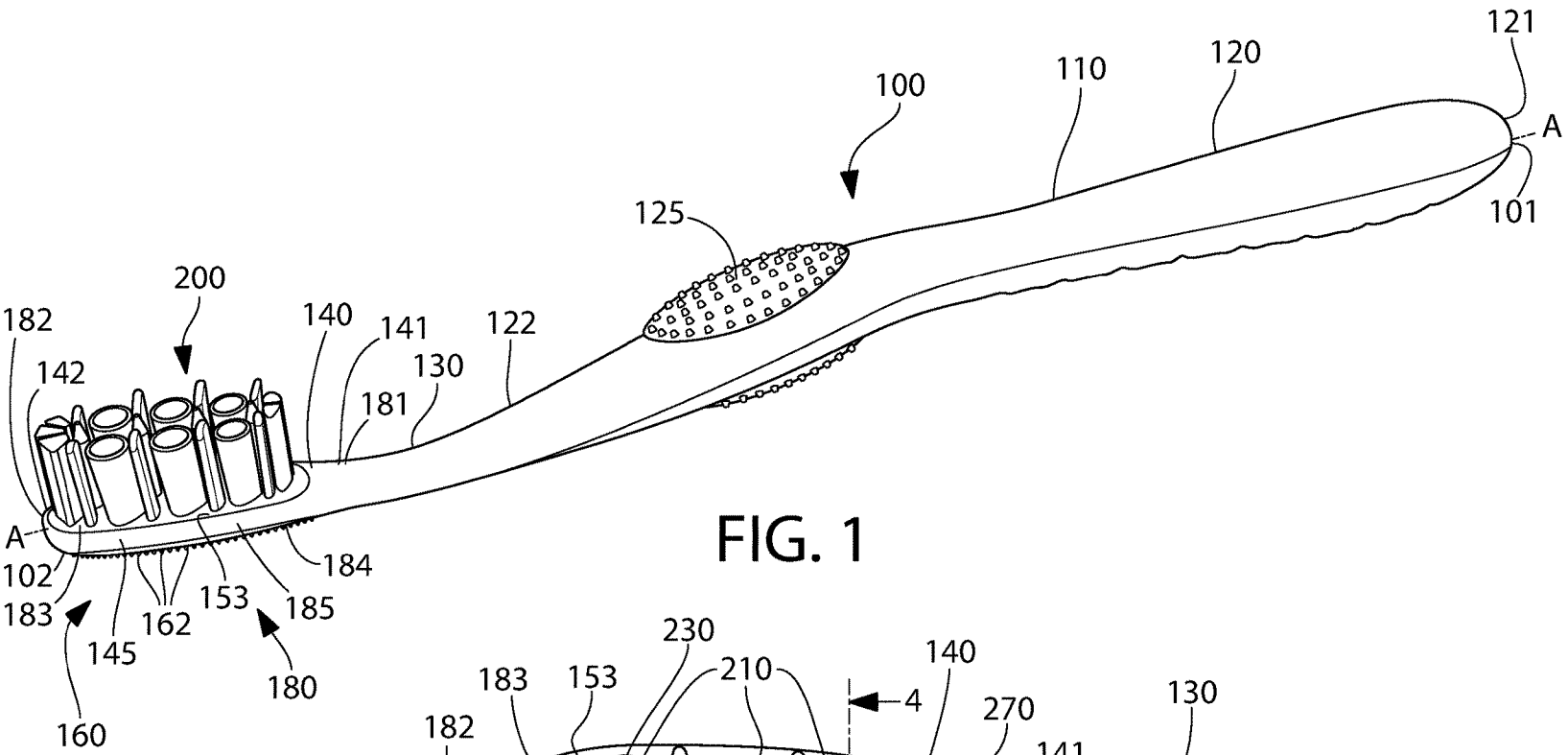
FIG. 1 is a perspective view of an oral care implement according to a first embodiment of the present invention.

The following description of the preferred embodiments is merely exemplary in nature and is in no way intended to limit the invention, its application, or uses. The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features.

In the following description, the invention is embodied in a manually-operated oral care implement, more specifically a manually-operated toothbrush. However, in other embodiments, the invention is embodied in a powered toothbrush wherein one or more cleaning elements provided to the head of the implement are drivable so as to be moved relative to the handle of the implement. In still further embodiments, the invention may be embodied in other forms of oral care implements, such as a soft-tissue cleansing implement, or another implement designed for oral care. It is to be understood that other embodiments may be utilized, and that structural and functional modifications may be made without departing from the scope of the present invention.

As used herein, the term "cone", and derivatives thereof such as "conical" and "conically", covers full cones and truncated cones, such as frusto-cones. As used herein, the term "apex" of a cavity means a, or the, deepest portion or point of the cavity from an open end of the cavity.

FIGS. 1 to 4 illustrate an oral care implement, in this case a toothbrush, according to a first embodiment of the present invention, generally designated with the reference numeral 100. The toothbrush 100 has a body 110 comprising a handle portion 120, a head portion 140, and a neck portion 130 that connects the handle portion 120 to the head portion 140. The head portion 140 is an end portion of the body 110 and is provided with a set 200 of cleaning elements for cleaning surfaces in a user's mouth, such as surfaces of their teeth.

The implement 100 has a head 180, comprising the head portion 140 of the body 110, the set 200 of cleaning elements, and a soft tissue cleaner 160, each of which is described in more detail below. In a variation to this embodiment, the soft tissue cleaner 160 is omitted.

The head portion 140 has a first, proximal end 141 and a second, distal end 142. The handle portion 120 has a first, proximal end 121 and a second, distal end 122. The neck portion 130 connects the distal end 122 of the handle portion 120 to the proximal end 141 of the head portion 140. The neck portion 130 is generally of a narrower cross sectional area than at least the distal end 122 of the handle portion 120 and, in some embodiments, the neck portion 130 is generally of a narrower cross sectional area than all portions of the handle portion 120.

The handle portion 120 of the body 110 provides the user with a mechanism by which he/she can readily grip and manipulate the toothbrush 100, includes ergonomic features which provide a high degree of control for the user while maintaining comfort, and may be formed of many different shapes and with a variety of constructions.

Generally, the toothbrush 100 extends from a proximal end 101 (which is also the proximal end 121 of the handle portion 120) to a distal end 102 (which is also the distal end 142 of the head portion 140) along a longitudinal axis A-A. Although the handle portion 120 is a non-linear structure in the illustrated embodiment, the longitudinal axis A-A of the implement 100 is linear in the illustrated embodiment. However, the invention is not so limited, and in certain embodiments, the implement 100 may have a simple linear handle portion 120 that is longitudinally aligned along the linear longitudinal axis A-A of the implement 100.

The head portion 140 is connected to the handle portion 120 via the neck portion 130. In this embodiment, the head portion 140, neck portion 130 and handle portion 120 are formed as an integral structure using an injection molding process. The head portion 140 is substantially immovable relative to the neck portion 130 and handle portion 120. The head portion 140, handle portion 120 and neck portion 130 are together a single, unitary structure. That is, the body 110 is a unitary body. However, in other embodiments, the head portion 140 and the neck portion 130 together may be formed as a separate component from the handle portion 120, which separate components are operably connected at a later stage of the manufacturing process by any suitable technique known in the art, including without limitation thermal welding, sonic welding, a tight-fit assembly, a coupling sleeve, adhesion, fasteners, and a snap-fit connection. Whether the head and neck portions 140, 130 and the handle portion 120 are constructed as a single piece or a multi-piece assembly (including connection techniques) is not limiting of the present invention in all embodiments. Furthermore, other manufacturing techniques may be used in place of and/or in addition to injection molding to create the handle portion 120 and/or the head portion 140 (or components thereof) and/or the neck portion 130, such as milling and/or machining.

In this embodiment, the body 110 comprising each of the head portion 140, neck portion 130 and handle portion 120 is constructed of a hard, substantially rigid material, specifically the hard plastic polypropylene (PP). However, in variations to this embodiment, the head portion 140 may instead or additionally be constructed of one or more of the following hard materials: polyethylene, polypropylene, polyamide, polyester, cellulosics, styrene-acrylonitrile (SAN), acrylic, acrylonitrile butadiene styrene (ABS) and a thermoplastic. Also, in variations to this embodiment, the handle portion 120 and/or the neck portion 130 may instead or additionally be constructed of one or more of those materials. An optional thumb grip 125 is provided on a front side of the handle portion 120, and an optional rear grip 127 is provided on a rear side of the handle portion 120 opposite to the front side of the handle portion 120. The thumb and rear grips 125, 127 are non-unitary with the body 110, and may be formed of any of the materials discussed below for the soft tissue cleaner 160.

The head 180 generally comprises a first surface 183, on a front side of the head 180, and a second surface 184, on a rear side of the head 180 opposite to the first side and thus opposite to the first surface 183. The first surface 183 and the second surface 184 of the head 180 can take on a wide variety of shapes and contours, none of which are limiting of the present invention. For example, the first and second surfaces 183, 184 can be planar, contoured or combinations thereof. The first surface 183 and second surface 184 are joined by a peripheral or lateral surface 145 of the head portion 140, which is a peripheral or lateral surface 185 of the head 180. The cleaning elements of the set 200 are provided at, and extend outward from, the first surface 183 of the head 180 for cleaning contact with an oral surface, preferably teeth.

While the set 200 of cleaning elements is particularly suited for cleaning teeth, the set 200 of cleaning elements can also be used to clean oral soft tissue, such as a tongue, gums, or cheeks instead of or in addition to teeth. As used herein, the term "cleaning element" is used in a generic sense to refer to any structure that can be used to clean, massage or polish an oral surface, such as teeth or soft tissue, through relative surface contact.

In this embodiment, the set 200 of cleaning elements comprises the following different types of cleaning elements, each of which extends from the first surface 183 of the head 180 and is discussed in more detail below: groups 210 of non-parallel tooth cleaning elements 220, pointed cleaning elements 250, raised cleaning elements 260, and distal and proximal cleaning elements 270.

Figure 4:
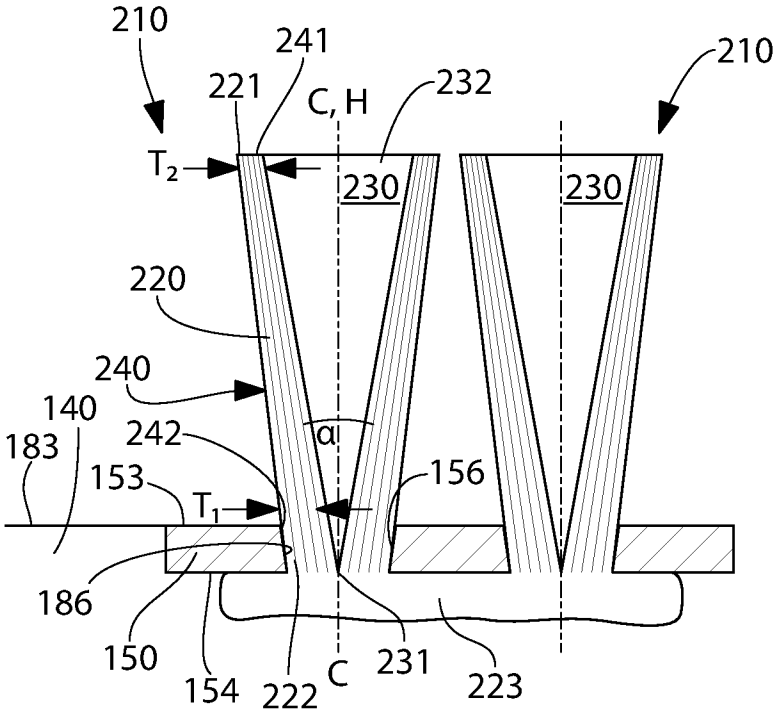
FIG. 4 is a partial cross-sectional view of the head taken along line 4-4 in FIG. 2.
Figure 3:
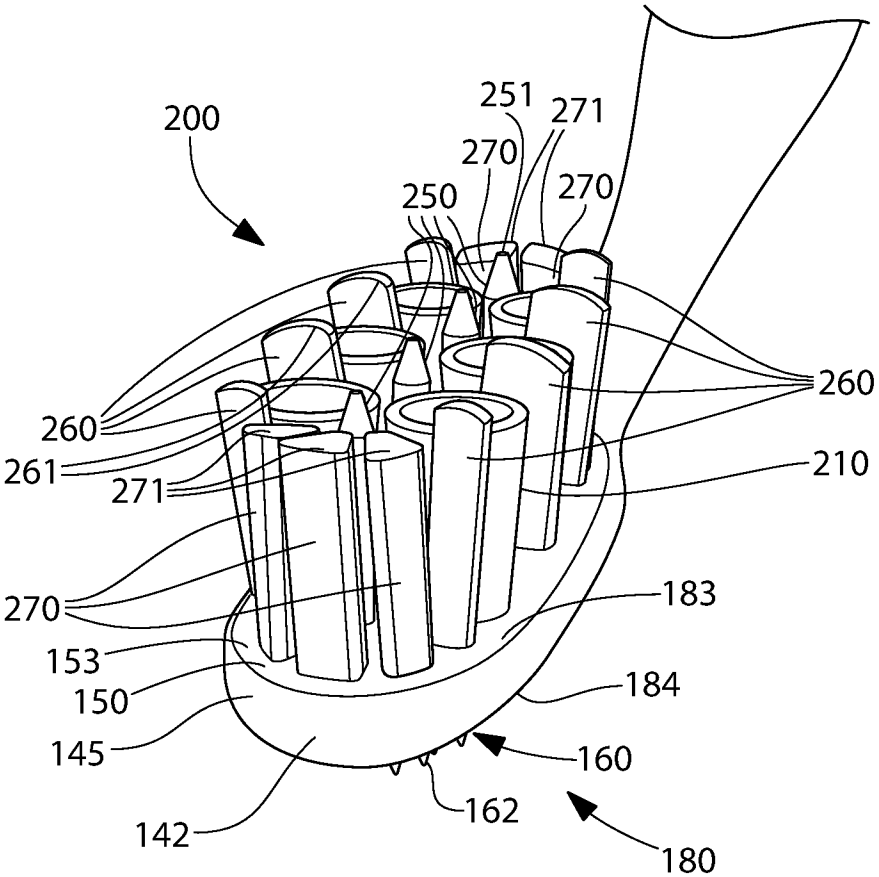
FIG. 3 is an enlarged perspective view of the head of the implement of FIG. 1.

With reference specifically to FIG. 4, the groups 210 of tooth cleaning elements 220 will be described. In this embodiment, the implement 100 has a plurality of groups 210 of tooth cleaning elements 220. However, in variations to this embodiment, such as the third embodiment shown in FIGS. 7 and 8 and discussed below, only one group 210 of non-parallel tooth cleaning elements 220 is provided. For simplicity, only one of the groups 210 of the first embodiment will be described in detail, but it will be understood that each of the groups 210 of the first embodiment is of substantially the same construction.

Each of the non-parallel tooth cleaning elements 220 of the group 210 is a flexible, nylon bristle that extends from the first surface 183 of the head 180. Accordingly, the group 210 of non-parallel tooth cleaning elements 220 comprises a tuft of bristles. The non-parallel nature of the tooth cleaning elements 220 of the group 210 results from some, or all, of the tooth cleaning elements 220 of the group 210 not being parallel to others of the tooth cleaning elements 220 of the group 210. Each of the tooth cleaning elements 220 has a (optionally tapered) distal end 221 furthest from the first surface 183 of the head 180, an opposite proximal end 222, and is linear, or substantially linear, between its distal end 221 and the first surface 183 of the head 180.

The tooth cleaning elements 220 define therebetween a cavity 230. That is, the cavity 230 is located between the tooth cleaning elements 220 and is bound by the tooth cleaning elements 220. More specifically, the tooth cleaning elements 220 together define a wall 240 around the cavity 230, the wall 240 having a proximal end 242 adjacent the first surface 183 of the head 180 and a distal end 241 distal from the first surface 183 of the head 180, the distal end 241 being defined by distal ends 221 of a plurality (optionally all) of the tooth cleaning elements 220. The wall 240 surrounds the cavity 230. In the present embodiment, in which the tooth cleaning elements 220 of the group 210 are packed closely together so that each of the tooth cleaning elements 220 of the group 210 contacts at least one other of the tooth cleaning elements 220 of the group 210, the wall 240 is a continuous wall 240 around the cavity 230. Preferably the wall 240 extends for 360 degrees around the cavity 230. Preferably the wall 240 is free of gaps therein.

In this embodiment, the distal end 241 of the wall 240 has a substantially linear side profile. In this embodiment, the distal end 241 of the wall 240 is substantially planar. Moreover, the distal end 241 of the wall 240 is substantially parallel to the first surface 183 of the head 180. In other embodiments, the distal end 241 of the wall 240 could be non-planar and/or non-parallel to the first surface 183 of the head 180. In still further variations to this embodiment, the distal end 241 of the wall 240 may have an alternative side profile, such as a non-linear profile, an S-shaped profile, a wavy profile, a serrated profile, a U-shaped profile, a V-shaped profile, or a pointed profile.

A thickness T of the wall 240 measured from an interior side 243 of the wall 240 facing the cavity 230 to an opposite, exterior side 244 of the wall 240 is less at the distal end 241 of the wall 240 than at the proximal end 242 of the wall 240. That is, the thickness T2 of the wall 240 at the distal end 241 of the wall 240 is less than the thickness T1 of the wall 240 at the proximal end 242 of the wall 240. The maximum thickness T1 of the wall 240 is at the proximal end 242 of the wall 240, while the minimum thickness T2 of the wall 240 is at the distal end 241 of the wall 240. The thickness of the wall 240 decreases linearly (i.e. at a regular rate) between the proximal end 242 of the wall 240 and the distal end 241 of the wall 240. That is, the wall 240 tapers in thickness from the proximal end 242 of the wall 240 to the distal end 241 of the wall 240. Moreover, a cross sectional area of the wall 240 at the distal end 241 of the wall 240 is substantially equal to a cross sectional area of the wall 240 at the proximal end 242 of the wall 240. Furthermore, at any point between the distal end 241 and the proximal end 242 of the wall 240, the thickness of the wall 240 is substantially constant around a full perimeter of the cavity 230. The wall 240 is preferably rotationally symmetrical.

The cavity 230 has an opening 232 at the distal end 241 of the wall 240 and an apex 231 at a position in the cavity 230 furthest from the distal ends 221 of the tooth cleaning elements 220 of the group 210, i.e. furthest from the opening 232 of the cavity 230. In this embodiment, the apex 231 is formed at the point (see FIG. 4) where plural of the tooth cleaning elements 220 of the group 210 are in contact with one another. The significance of the cavity 230 having an apex 231, and more specifically an apex 231 formed by the tooth cleaning elements 220 rather than by some other element, such as part of the first surface 183 of the head 180, will be explained below.

In this embodiment, the apex 231 is within a hole 186 in the head 180, and the group 210 of non-parallel tooth cleaning elements 220 extends from within the hole 186. The hole 186 has an axis H-H and a cross-sectional area orthogonal to the axis H-H. The cross-sectional area of the hole 186 varies along the axis H-H. In particular, the hole 186 is a tapered hole 186, whereby the cross-sectional area reduces as distance into the hole 186 from the first surface 183 increases. In other embodiments, the hole 186 is not tapered.

In this embodiment, the cavity 230 is conically-shaped, with an axis C of the cone being the imaginary straight line that passes through the apex 231 and about which the opening 232 has rotational symmetry. More specifically, in this embodiment the cavity 230 has the shape of a right circular full cone, whereby the opening 232 is circular and substantially planar, and the axis C of the cone passes through the opening 232 at right angles to the plane of the opening 232. In a variation, the opening 232 may instead by elliptical (and optionally substantially planar), so that the cavity has the shape of an elliptical cone, optionally a right elliptical cone. In further variations to this embodiment, the cavity 230 may instead take the shape of an oblique circular or elliptical cone, in which the axis C is not at right angles to the plane of the opening 232. In other embodiments, the opening 232 could take a still different shape, such as a square or rectangle, in which case the cavity 230 would have the shape of a pyramid (note that a pyramid is a cone with a polygonal base). In still other embodiments, instead of having the shape of a full cone, the cavity 230 could instead have the shape of a truncated cone, such as a frusto-cone, n which case the apex 231 would not be a point as such, but instead would be an area preferably formed by material of plural of the tooth cleaning elements 220 of the group 210.

Preferably, a distance between two diametrically-opposed cavity-facing points on the wall 240 (which points would be located at or adjacent the opening 232) is at least 10 times the width of any one of the tooth cleaning elements 220. In other words, preferably a width of the opening 232 is at least 10 times the width of any one of the tooth cleaning elements 220. More preferably, this multiple is at least 20 times, and most preferably, this multiple is at least 30 times or at least 40 times. Preferably, the distance is at least 5 times the thickness T2 of the wall 240 at the distal end 241 of the wall 240, and most preferably the distance is at least 10 times the thickness T2 of the wall 240 at the distal end 241 of the wall 240.

Preferably, the internal angle $\alpha$ of the conical cavity, i.e. the angle at the apex 231 of the cavity 230, is at least 20 degrees. More preferably, the angle $\alpha$ is at least 25 degrees, or at least 30 degrees. Preferably, the angle $\alpha$ is less than 45 degrees, and more preferably the angle $\alpha$ is less than 40 degrees, or less than 35 degrees. In some embodiments, this angle $\alpha$ is the angle between two diametrically-opposed cavity-facing tooth cleaning elements 220 of the group 210.

In this embodiment, each of the groups 210 of tooth cleaning elements 220 comprises a plurality of flexible, nylon bristles 220. However, in variations to this embodiment, the tooth cleaning elements 220 of the group(s) 210 may additionally or alternatively comprise any one or more of the following, without limitation: rigid bristles, filament bristles, fibre bristles, nylon bristles, spiral bristles, tapered bristles, rubber bristles, elastomeric protrusions, flexible polymer protrusions, co-extruded filaments, flag bristles, crimped bristles, anti-bacterial bristles and combinations thereof and/or structures containing such materials or combinations.

The tooth cleaning elements 220 of the group(s) 210 can be connected to the head 140 using anchor free tufting (AFT). Alternatively, the cleaning elements 220 could be mounted to tuft blocks or sections by extending through suitable openings in the tuft blocks so that the base of the cleaning elements 220 is mounted within or below the tuft block. Staple technology may instead be used.

In AFT, the tooth cleaning elements 220 (bristles or other elements, such as elastomeric elements) are arranged to extend through a passage 156 in a member 150, which in this embodiment is a plate but in a variation to this embodiment is a membrane. Respective first portions, i.e. free distal ends, 221 of the tooth cleaning elements 220 on a first side 153 of the plate 150 perform the cleaning function. Respective second portions, e.g. proximal ends, 222 of the tooth cleaning elements 220 on a second side 154 of the plate 150 are fused, or melted together, by heat to form a melt matte 223 and to be anchored in place relative to the plate 150. The plate 150 is secured to the pre-made head portion 140, such as by ultrasonic welding. Alternatively, the material of the head portion 140 is subsequently moulded over the member 150 to envelop, or substantially envelop, the member 150.

Although, as shown in FIG. 4, the member 150 is a plate or membrane that is a separate entity to the head portion 140, in a variation to this embodiment the member 150 is part of the head portion 140 itself, which head portion 140 may be unitary with, or otherwise connected to, the handle portion 120 and/or the neck portion 130 of the implement 100, and thus is part of the head 180. In either arrangement, the hole 186 comprises the passage 156 through the member 150. Preferably, the passage 156 has a length between the first and second sides 153, 154 of the member 150 of from 0.5 mm to 2.0 mm, more preferably from 0.75 mm to 1.5 mm.

From FIG. 4, it can be seen that the apex 231 of the cavity 230 is disposed in the hole 186 on the second side 154 of the member 150. However, in a variation to this embodiment, the apex 231 is disposed in the passage 156, which is comprised in the hole 186. In this embodiment, the passage 156 in the member 150 is a tapered passage. However, in other embodiments, this need not be the case.

At the rear side of the head 180 is disposed the soft tissue cleaner 160, preferably formed from resilient material. The soft tissue cleaner 160 is comprised in the second surface 184 of the head 180. The soft tissue cleaner 160 comprises a pad and a plurality of flexible protrusions 162 protruding from the pad. Preferably, the pad also is of a flexible material and the pad and protrusions 162 are a unitary component. Preferably the pad and the protrusions 162 are made of an elastomer, such as a thermoplastic elastomer (TPE), or styrene-ethylene/butylene-styrene (SEBS).

Some methods of manufacturing an oral care implement 100 according to the present invention will now be described. Broadly speaking, each of the methods comprises: providing a member 150 and providing a group 210 of non-parallel tooth cleaning elements 220 that together define therebetween a conically-shaped cavity 230, wherein the tooth cleaning elements 220 extend through a passage 156 formed in the member 150 so that respective first portions 221 of the tooth cleaning elements 220 are disposed on a first side 153 of the member 150 and respective second portions 222 of the tooth cleaning elements 220 are disposed on a second side 154 of the member 150, and then fixing together the second portions 222 of the tooth cleaning elements 220 at the second side 154 of the member 150.

As shown in FIG. 4, the member 150 may be a plate or membrane that is a separate entity to a head portion 140 of the implement 100. Alternatively, the member is part of the head portion 140. The head portion 140 may be unitary with, or otherwise connected to, the handle portion 120 and/or the neck portion 130 of the implement 100.

The method of manufacture of the implement 100 shown in FIG. 1 comprises inserting the tooth cleaning elements 220 (each of which is a bristle, optionally a tapered bristle) into the tapered passage 156, so that each of the tooth cleaning elements 220 has a first portion 221 on the first side 153 of the member 150 and has a second portion 222 (in this embodiment, a proximal end) on the second side 154 of the member 150, and then arranging the tooth cleaning elements 220 so that together the tooth cleaning elements 220 define therebetween the conically-shaped cavity 230.

More specifically, in one embodiment, the inserting comprises disposing a plurality of (preferably between two and four) picks (i.e. individual clusters) of mutually-aligned tooth cleaning elements 220 into the passage 156 with the picks at respective different orientations relative to one another. Each of the picks may be inserted into the passage 156 from a different direction to each of the other picks with the picks at respective different orientations relative to one another during the inserting, or all of the picks may be inserted into the passage 156 from the same direction, for example in a direction parallel to the shortest distance between the first and second sides 153, 154 of the member 150, with the picks at respective different orientations relative to one another during the inserting. Either way, the inserting comprises disposing at least some of the tooth cleaning elements 220 in the passage 156 at a different orientation to others of the tooth cleaning elements 220. The picks may be inserted into the passage 156 at the same time or successively.

In a variation to this process, the tooth cleaning elements 220 (whether in individual picks or as one set) are all inserted into the passage 156 with all the tooth cleaning elements 220 being substantially parallel to one another.

The arranging may comprise moving at least some of the tooth cleaning elements 220 relative to others of the tooth cleaning elements 220 and relative to the member 150 to cause the tooth cleaning elements 220 to define therebetween the conically-shaped cavity 230, such as by introducing the first portions 221 of the tooth cleaning elements 220 into a mold (not shown) and using the mold to move the tooth cleaning elements 220. Alternatively, the arranging may comprise allowing at least some of the tooth cleaning elements 220 to move relative to others of the tooth cleaning elements 220 and relative to the member 150 to cause the tooth cleaning elements 220 to define therebetween the conically-shaped cavity 230, such as by introducing the first portions 221 of the tooth cleaning elements 220 into a mold and allowing the tooth cleaning elements 220 to conform to a shape of the mold, e.g. under the influence of gravity.

In any event, ultimately the tooth cleaning elements 220 extending through the passage 156 have respective different orientations relative to one another. Each of the tooth cleaning elements 220 of the group 210 extends through the passage 156 with a distal end 221 thereof on the first side 153 of the member 150 and the proximal end 222 thereof on the second side 154 of the member 150. The tooth cleaning elements 220 of the group 210 are positioned so that they contact one another on the second side 154 of the member 150, and are splayed apart from one another on the first side 153 of the member 150. Over all, the tooth cleaning elements 220 define the conically-shaped cavity 230 therebetween. The tooth cleaning elements 220 may contact one another at their proximal ends 222, or at respective points a short distance from their respective proximal ends 222, to define the apex 231 of the cavity 230. As discussed above, the cavity 230 of the implement 100 has the shape of a right circular full cone. In other embodiments, depending on the relative orientations of the tooth cleaning elements 220, the cavity 230 may instead have any of the other shapes discussed above.

Next, the tooth cleaning elements 220 are fixed at respective different orientations relative to one another by holding the tooth cleaning elements 220 and heating up the second portions 222 (i.e. the proximal ends, in this embodiment) of the tooth cleaning elements 220 to cause the second portions 222 to melt and run into one another. The heat is then removed and the second portions 222 of the tooth cleaning elements 220 are allowed to cool and harden into one monolithic mass or melt matte 223, so that the picks of tooth cleaning elements 220 become fused together at the second side 154 of the member 150. In some embodiments, the second portions 222 of the tooth cleaning elements 220 become fixed to the member 150 during this process.

Preferably, this process results in the apex 231 of the cavity 230 becoming formed on the second side 154 of the member 150. However, in other cases, the apex 231 may become formed within the passage 156. The position of the apex 231 may change during the fixing process as material of the tooth cleaning elements 220 flows. Where the apex 231 is formed relative to the passage 156 and relative to the member 150 as a whole depends upon how close to one another tooth cleaning elements 220 are held, the length of time for which the heating is carried out, and the material of the tooth cleaning elements 220. In any case, the fixed group 210 of non-parallel tooth cleaning elements 220 together define the wall 240, discussed above. As also discussed above, preferably the wall 240 is a continuous wall, and more preferably the wall 240 is free of gaps therein. Moreover, while in this embodiment the passage 156 is tapered and has a length of between 0.5 and 2.0 mm, in variations to this embodiment the passage 156 is not tapered and/or has a different length.

Next, in embodiments where the member comprises a plate or membrane 150 separate from the head portion 140, such as the embodiment shown in FIGS. 1 to 4, the member 150 including the group(s) 210 of tooth cleaning elements 220 is attached to the head portion 140 so that the member 150 becomes provided in the head 180 of the implement 100. This attaching may be by one of the methods discussed above. The first side 153 of the member 150 effectively forms part or all of the first surface 183 of the head 180, so that the group 210 of non-parallel tooth cleaning elements 220 extends from the first surface 183 of the head 180. In variations to this embodiment, the member 150 may end up embedded within the head 180. In alternative embodiments where the member 150 comprises part of the head portion 140, then this attachment process can be omitted.

The method of manufacturing the implement 100 shown in FIGS. 1 to 4 also includes providing the soft tissue cleaner 160 to form at least part of the second surface 184 of the head 180, which second surface 184 of the head 180 is opposite to the first surface 183 of the head 180. In some embodiments, the soft tissue cleaner 160 is in contact with the tooth cleaning elements 220 of the group 210, more specifically with the proximal ends 222 thereof. The soft tissue cleaner 160 may be a pre-made entity, for example made of TPE, which is adhered to the head portion 140 and to the tooth cleaning elements 220 of the group 210. Alternatively, the method may involve flowing a material, such as a TPE, onto the melt matte 223, and into any gaps left between the tooth cleaning elements 220 at or around their proximal ends 222, and then allowing the material to harden to form the soft tissue cleaner 160. The soft tissue cleaner 160 thus can be bound to the tooth cleaning elements 220 of the group 210.

The oral care implement 100 may be manufactured by a different method. For example, the hole(s) 186, the passage 156 and the member 150 may be omitted altogether. The tooth cleaning elements 220 may be individually provided to the first side 183 of the head 180, or a unitary structure including the individual tooth cleaning elements 220 may be provided to the first side 183 of the head 180 or to the hole 186. Such a unitary structure may be made of TPE.

A first benefit of the provision of the conically-shaped cavity 230 is that it provides the head 180 with a large volume for retaining toothpaste.

A second benefit of this structure is that the cavity 230 is easy to clean of toothpaste following a teeth cleaning session, since toothpaste captured in the cavity 230 is entirely or substantially unable to work its way down to the first surface 183 of the head 180 where it may become trapped. It is preferable that the cavity 230 has an apex 231 in the form of a point. In such cases, the toothpaste still less able to work its way down to the first surface 183 of the head 180.

A third benefit of the conically-shaped cavity 230 is that it holds the majority of the toothpaste at a position where it will be effective at cleaning the teeth. This is particularly the case in embodiments in which the wall 240 is a continuous wall 240 around the cavity 230, and more particularly the case when the cavity 230 has an apex 231 in the form of a point.

A fourth benefit of the structure is that, in embodiments where the tooth cleaning elements 220 are flexible, during a teeth cleaning session the tooth cleaning elements 220 are able to bend, flex or rotate (about the point apex 231, when provided) to come into contact with each other at, or close to, their distal ends 221. Thus, the cavity 230 is able to be significantly reduced in volume to cause toothpaste held in the cavity 230 to be completely, or substantially completely, expelled from the cavity 230 onto the teeth during a teeth cleaning session. As a result, the toothpaste becomes positioned at a contact zone of the tooth cleaning elements 220 with the teeth, thus enabling improved cleaning and/or polishing of a user's teeth using the toothpaste.

As discussed above, the set 200 of cleaning elements comprises pointed cleaning elements 250 that extend from the first surface 183 of the head 180 and have respective pointed distal ends 251. In each pointed cleaning element 250, the pointed distal end 251 is that part of the pointed cleaning element 250 furthest from the first surface 183 of the head 180. In some embodiments each pointed cleaning element 250 is an elastomeric component. However, in the present embodiment, each pointed cleaning element 250 comprises a group of bristles, wherein each of the bristles has a distal end furthest from the first surface 183 of the head 180, and wherein the distal ends of the bristles together define a pointed distal end 251 of the pointed cleaning element 250. The distal ends of some or all of the bristles themselves may be any shape, including flat, rounded or tapered. The distal ends 251 of the pointed cleaning elements 250 are further from the first surface 183 of the head 180 than the distal ends 221 of the non-parallel tooth cleaning elements 220 making up the groups 210. Due to their shape and height relative to the groups 210 of non-parallel tooth cleaning elements 220, the pointed cleaning elements 250 are particularly effective at cleaning between a user's teeth.

Figure 2:
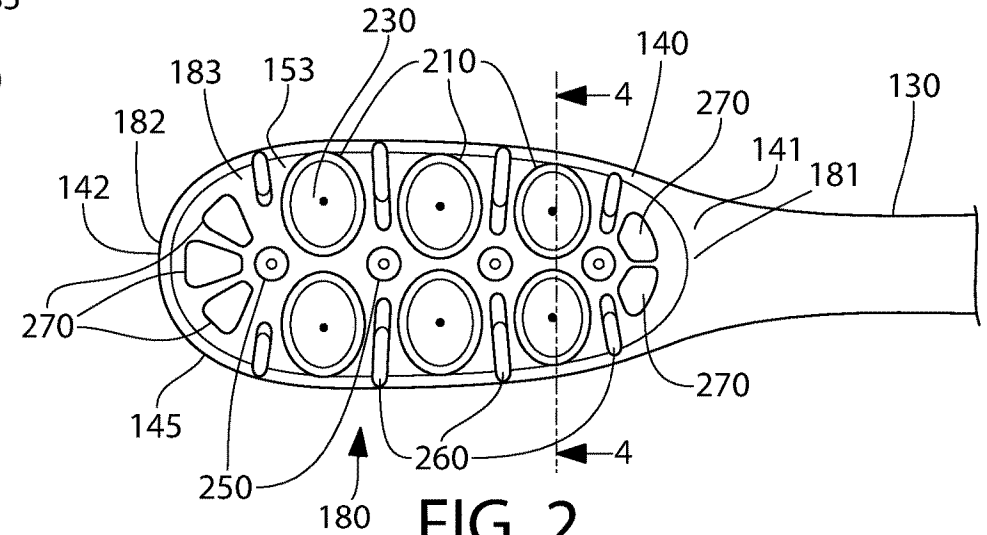
FIG. 2 is an enlarged plan view of a head of the implement of FIG. 1.

As is best shown in FIG. 2, the head 180 has a first end 181 and a second end 182. An axis extends between the first and second ends 181, 182, which axis is parallel to the longitudinal axis A-A of the implement 100 and extends along the longitudinal middle of the head 180. Plural ones of said pointed cleaning elements 250 are disposed on the head 180 spaced along this axis. More particularly, the implement 100 comprises a plurality of said pointed cleaning elements 250, and a plurality of said groups 210 of non-parallel tooth cleaning elements 220. The pointed cleaning elements 250 alternate with the groups 210 of non-parallel tooth cleaning elements 220 between the first end 181 and the second end 182 of the head 180. That is, between any two of the pointed cleaning elements 250, there is provided a pair of laterally-spaced groups 210 of the non-parallel tooth cleaning elements 220.

As discussed above, the set 200 of cleaning elements comprises raised cleaning elements 260 that extend from the first surface 183 of the head 180. Each of these cleaning elements 260 has a convex distal end 261 which is that part of the raised cleaning element 260 furthest from the first surface 183 of the head 180. In some embodiments each raised cleaning element 260 is an elastomeric component. However, in the present embodiment, each raised cleaning element 260 comprises a group of bristles, wherein each of the bristles has a distal end furthest from the first surface 183 of the head 180, and wherein the distal ends of the bristles together define a convex distal end 261 of the raised cleaning element 260. The distal ends of the bristles themselves may be any shape, including flat, rounded or tapered. The distal ends 261 of the raised cleaning elements 260 are further from the first surface 183 of the head 180 than the distal ends 221 of the non-parallel tooth cleaning elements 220 making up the groups 210, and approximately the same distance from the first surface 183 of the head 180 as the distal ends 251 of the pointed cleaning elements 250. Due to their shape and height relative to the groups 210 of non-parallel tooth cleaning elements 220, the raised cleaning elements 260 are particularly effective at sweeping away plaque and debris from surfaces in a user's mouth.

As is best shown in FIG. 2, plural ones of said raised cleaning elements 260 are disposed longitudinally spaced along the lateral edges of the first surface 183 of the head 180. The raised cleaning elements 260 alternate with the groups 210 of non-parallel tooth cleaning elements 220 between the first end 181 and the second end 182 of the head 180, so that pairs of the raised cleaning elements 260 are longitudinally positioned on the head 180 in alignment with ones of the pointed cleaning elements 250, so that the raised cleaning elements 260 flank the pointed cleaning element 250 on their lateral sides.

As discussed above, the set 200 of cleaning elements comprises distal and proximal cleaning elements 270 that extend from the first surface 183 of the head 180. The distal and proximal cleaning elements 270 are disposed at the first and second ends 181, 182 of the head 180. In some embodiments each of the distal and proximal cleaning elements 270 is an elastomeric component. However, in the present embodiment, each distal and proximal cleaning element 270 comprises a group of bristles, wherein each of the bristles has a distal end furthest from the first surface 183 of the head 180, and wherein the distal ends of the bristles together define a sloped distal end 271 of the distal and proximal cleaning element 270 that has a peak furthest from the centre of the first surface 183 of the head 180. The distal ends of the bristles themselves may be any shape, including flat, rounded or tapered. The peaks of the sloped distal ends 271 are approximately the same distance from the first surface 183 of the head 180 as the distal ends 251 of the pointed cleaning elements 250. Due to their shape, peak height and positioning on the head 180, the distal and proximal cleaning elements 270 are also effective at cleaning between a user's teeth. The distal cleaning elements 270 also are useable to reach far into the user's mouth, to clean effectively their rearmost molars.

Figure 5:
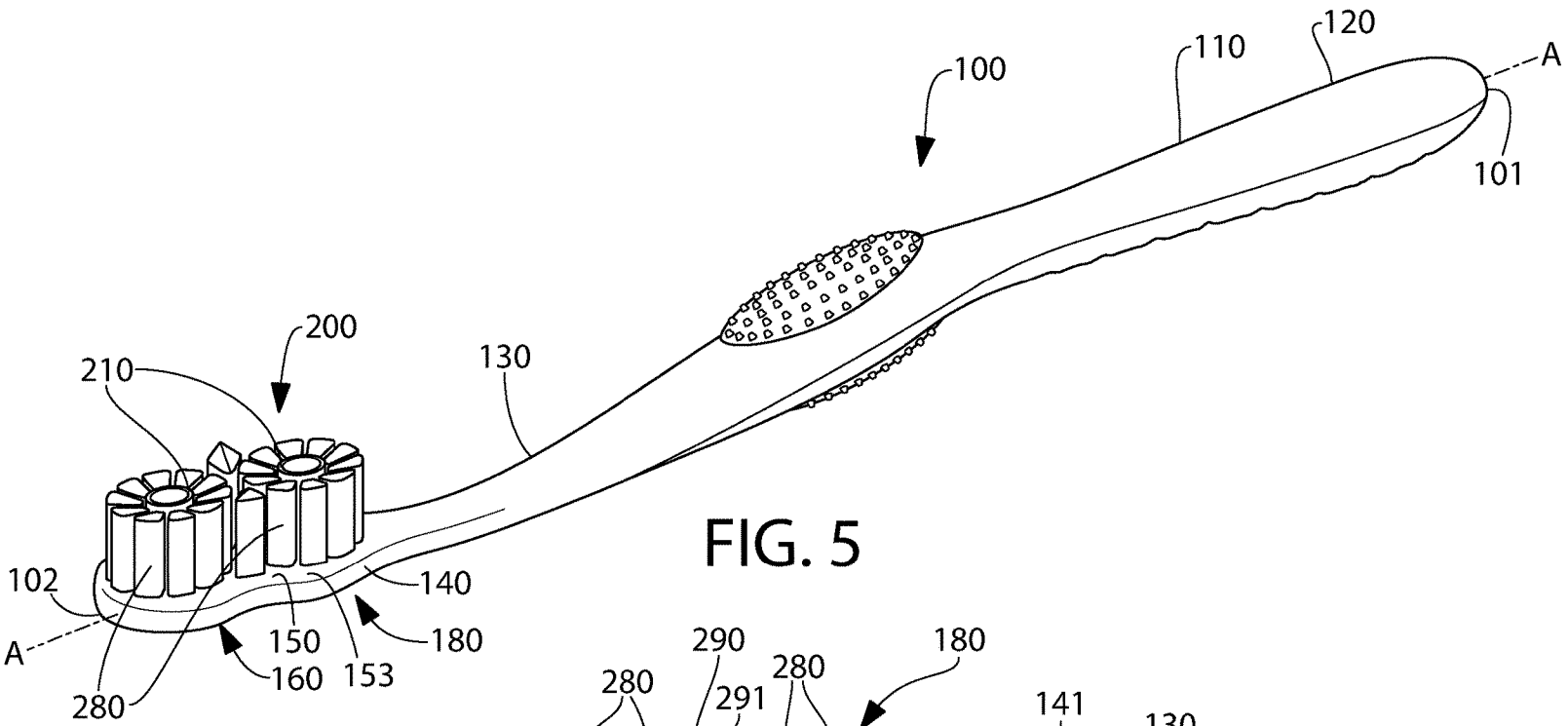
FIG. 5 is a perspective view of an oral care implement according to a second embodiment of the present invention.
Figure 6:
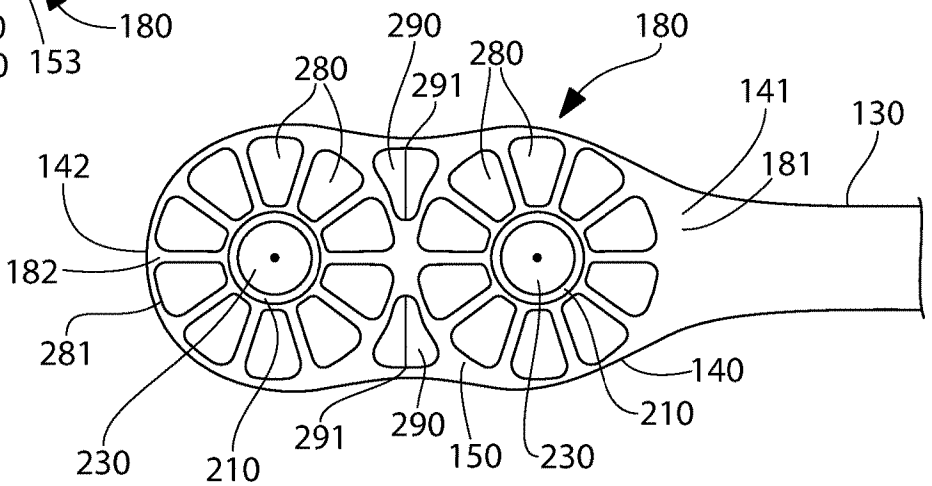
FIG. 6 is an enlarged plan view of a head of the implement of FIG. 5.

A second embodiment of the implement 100 of the present invention is shown in FIGS. 5 and 6. Like elements shown in FIGS. 1 to 4 are indicated in FIGS. 5 and 6 with the same reference numerals. In the interests of conciseness, the elements common to the two embodiments will not be described in detail again with reference to FIGS. 5 and 6. All of the above-described possible variations to the first embodiment are equally applicable to the second embodiment.

Whereas in the first embodiment the head 180 had a substantially elliptical or lozenge-shape, the head 180 of the implement 100 of the second embodiment has an outer shape in plan view similar to the outer edge of a number 8. The head 180 has a first end 181 and a second end 182. An axis extends between the first and second ends 181, 182, which axis is parallel to the longitudinal axis A-A of the implement 100 and extends along the longitudinal middle of the head 180. The head 180 includes only two groups 210 of non-parallel tooth cleaning elements 220 disposed on the head 180 spaced along this axis.

Surrounding each of the two groups 210 is a plurality of wedge-shaped cleaning elements 280, each of which has a wedge shape in plan view. In some embodiments each of the wedge-shaped cleaning elements 280 is an elastomeric component. However, in the present embodiment, each wedge-shaped cleaning element 280 comprises a group of bristles, wherein each of the bristles has a distal end furthest from the first surface 183 of the head 180, and wherein the distal ends of the bristles together define a sloped distal end 281 of the wedge-shaped cleaning element 280 that has a peak furthest from the centre of the cavity 230. The distal ends of the bristles themselves may be any shape, including flat, rounded or tapered.

At the longitudinal middle of the head 180, and disposed on the lateral edges of the first surface 183 of the head 180, is a pair of triangular-shaped cleaning elements 290, each of which has a substantially triangular shape in plan view. An inward-facing vertex of each of the triangular-shaped cleaning elements 290 faces an inward-facing vertex of the other of the triangular-shaped cleaning elements 290. In some embodiments each of the triangular-shaped cleaning elements 290 is an elastomeric component. However, in the present embodiment, each triangular-shaped cleaning element 290 comprises a group of bristles, wherein each of the bristles has a distal end furthest from the first surface 183 of the head 180, and wherein the distal ends of the bristles together define a pointed distal end 291 of the triangular-shaped cleaning element 290 that has a peak at the midpoint of the side of the triangle opposite from the inward-facing vertex. The distal ends of the bristles themselves may be any shape, including flat, rounded or tapered. The distal ends 291 of the triangular-shaped cleaning elements 290 are further from the first surface 183 of the head 180 than the distal ends 221 of the non-parallel tooth cleaning elements 220 making up the groups 210. Due to their shape and height relative to the groups 210 of non-parallel tooth cleaning elements 220, the triangular-shaped cleaning elements 290 are particularly effective at cleaning between a user's teeth.

Figure 7:
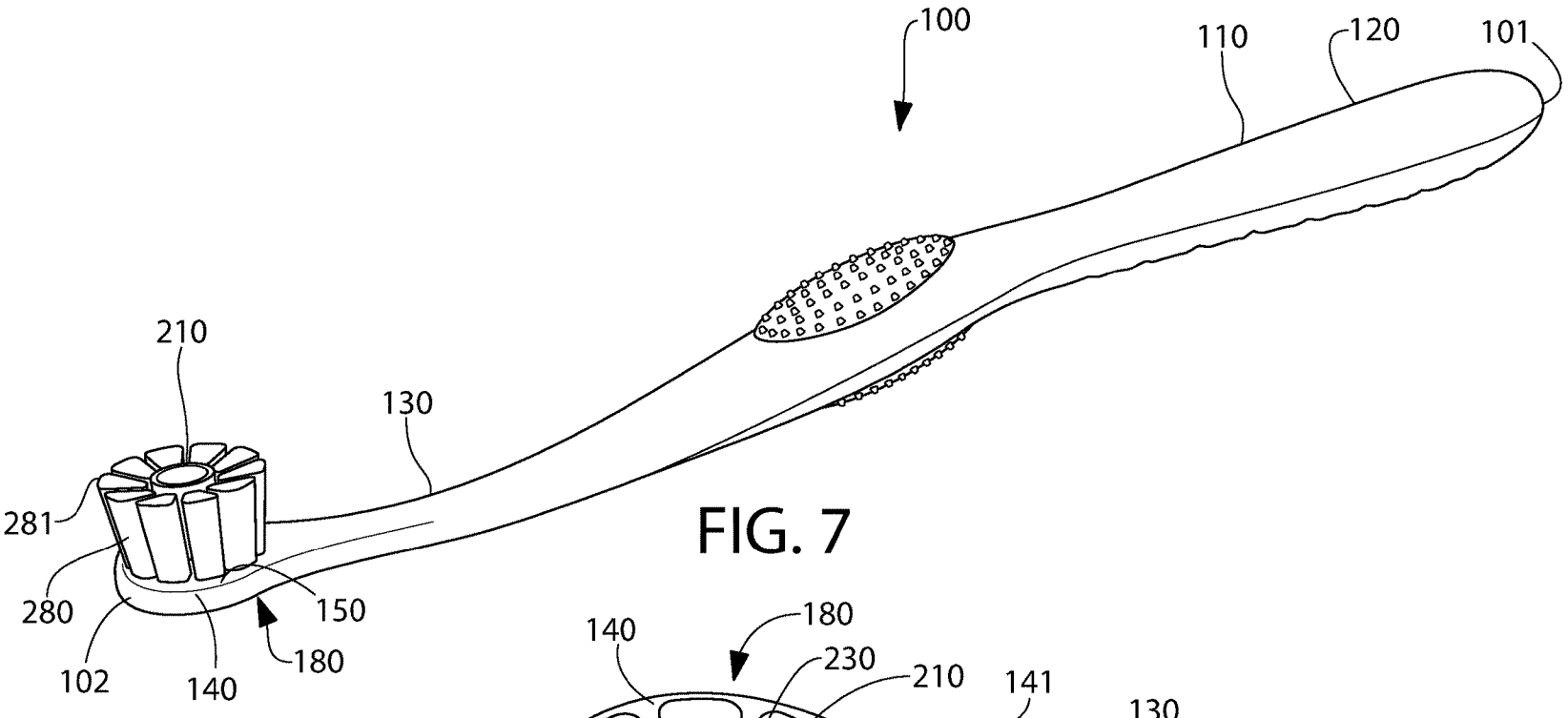
FIG. 7 is a perspective view of an oral care implement according to a third embodiment of the present invention.
Figure 8:
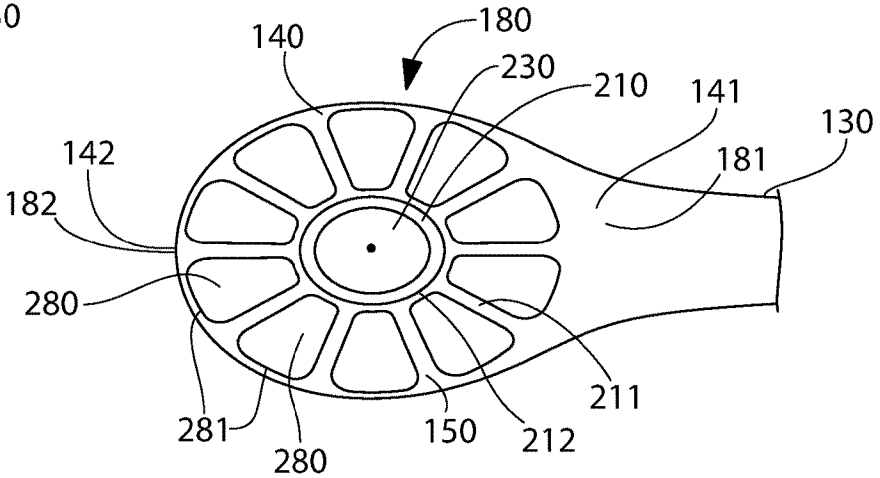
FIG. 8 is an enlarged plan view of a head of the implement of FIG. 7.

A third embodiment of the present invention is shown in FIGS. 7 and 8. Like elements shown in FIGS. 5 and 6 are indicated in FIGS. 7 and 8 with the same reference numerals. In the interests of conciseness, the elements common to the two embodiments will not be described in detail again with reference to FIGS. 7 and 8. All of the above-described possible variations to the first and second embodiments are equally applicable to the third embodiment.

The head 180 of the implement 100 of the third embodiment has a substantially elliptical outer shape in plan view. The head 180 includes only one group 210 of non-parallel tooth cleaning elements 220. The tooth cleaning elements 220 together define therebetween a cavity 230 that has the shape of an elliptical cone. The group 210 is disposed on the head 180 with the cavity 230 substantially coaxial with the elliptical outer shape of the head 180.

Surrounding the group 210 is a plurality of wedge-shaped cleaning elements 280, each of which has a wedge shape in plan view. The group 210 is separated from the wedge-shaped cleaning elements 280 by a gap 211. Each of the wedge-shaped cleaning elements 280 are separated from each other wedge-shaped cleaning element 280 by a space 212. In some embodiments each of the wedge-shaped cleaning elements 280 is an elastomeric component. However, in the present embodiment, each wedge-shaped cleaning element 280 comprises a group of bristles, wherein each of the bristles has a distal end furthest from the first surface 183 of the head 180, and wherein the distal ends of the bristles together define a sloped distal end 281 of the wedge-shaped cleaning element 280 that has a peak furthest from the centre of the cavity 230. The distal ends of the bristles themselves may be any shape, including flat, rounded, or tapered.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the scope of the invention should be construed broadly as set forth in the appended claims.

What is claimed is:

1. An oral care implement comprising:

a head extending along a longitudinal axis and having a first surface, a second surface opposite the first surface, and a side surface extending between the first surface and the second surface;

a central bristle tuft extending from a central portion of the first surface of the head, wherein the central bristle tuft has an elliptical shape in plan view having a major axis and a minor axis, the major axis extending along the longitudinal axis of the head; and a plurality of perimetric bristle tufts extending from the first surface of the head and arranged to circumferentially surround the central bristle tuft, the plurality of perimetric bristle tufts comprising three rotationally symmetric pairs of bristle tufts, each of the rotationally symmetric pairs of bristle tufts being different and each of the rotationally symmetric pairs of bristle tufts being wedge-shaped in plan view;

wherein each of the plurality of perimetric bristle tufts comprise an outer sidewall, the outer sidewalls of the plurality of perimetric bristle tufts forming portions of an ellipse, the ellipse centered on the central bristle tuft; and wherein each of the plurality of perimetric bristle tufts has an inner sidewall adjacent the central bristle tuft, adjacent ones of the plurality of perimetric bristle tufts are separated by a space and the inner sidewalls of the plurality of perimetric bristle tufts are separated from the central bristle tuft by a gap, each of the spaces having a width in a circumferential direction about the central bristle tuft that is greater than a width of the gaps as measured in a radial direction from the central bristle tuft.

2. The oral care implement according to claim 1, wherein each of the plurality of perimetric bristle tufts comprises an inclined distal surface that slopes downward toward the central bristle tuft.

3. The oral care implement according to claim 1 wherein each of the plurality of perimetric bristle tufts comprises a group of bristles having a distal end located furthest from the first surface of the head, the distal ends of the group of bristles together defining a sloped distal end of the perimetric bristle tuft that has a peak furthest from the central bristle tuft.

4. The oral care implement according to claim 1 wherein adjacent ones of the plurality of perimetric bristle tufts are separated by a space, the spaces having widths measured in a circumferential direction about the central bristle tuft which are less than a width of each of the plurality of perimetric bristle tufts measured in the circumferential direction about the central bristle tuft.

5. The oral care implement according to claim 1 wherein each of the perimetric bristle tufts is immediately adjacent the central bristle tuft and immediately adjacent an outer perimeter of the first surface of the head.

6. The oral care implement according to claim 1 wherein the central bristle tuft extends along a central tuft axis that is located at an intersection of the longitudinal axis of the head and a transverse axis of the head.

7. The oral care implement according to claim 1 wherein each of the plurality of perimetric bristle tufts comprises an inner sidewall that faces the central bristle tuft, the outer sidewall opposite the inner side wall, the outer sidewall having a width that is greater than a width of the inner sidewall.

8. The oral care implement according to claim 7 wherein the inner sidewall of each of the plurality of perimetric bristle tufts is spaced apart from the central bristle tuft by a gap.

9. The oral care implement according to claim 7 wherein the inner side wall of each of the plurality of perimetric bristle tufts faces the inner side wall of one other of the plurality of perimetric bristle tufts, and wherein each pair of perimetric bristle tufts having inner side walls that face each other have the same shape in plan view.

10. The oral care implement according to claim 9 wherein some of the plurality of perimetric bristle tufts have a different shape in plan view than others of the plurality of perimetric bristle tufts.

11. The oral care implement according to claim 1 wherein the central bristle tuft comprises a plurality of tooth cleaning elements that surround a cavity.

12. The oral care implement according to claim 11 wherein the cavity has a shape of an elliptical cone.

13. The oral care implement according to claim 1 wherein the central bristle tuft and each of the perimetric bristle tufts comprise a plurality of bristles.

14. An oral care implement comprising:

a head extending along a longitudinal axis, the head having a substantially elliptical outer shape in plan view;

a central bristle tuft extending from a central portion of a first surface of the head, the central bristle tuft having a substantially elliptical outer shape in plan view with a major axis that is located on the longitudinal axis of the head;

a plurality of wedge-shaped perimetric bristle tufts extending from the first surface of the head and arranged to circumferentially surround the central bristle tuft, wherein each of the perimetric bristle tufts comprises an inner sidewall that is immediately adjacent the central bristle tuft and an outer sidewall opposite the inner sidewall that is immediately adjacent an outer perimeter of the first surface of the head, the outer sidewall having a width that is greater than a width of the inner sidewall, the plurality of perimetric bristle tufts comprising three rotationally symmetric pairs of bristle tufts, each of the rotationally symmetric pairs of bristle tufts being different; and wherein each of the plurality of perimetric bristle tufts comprises an inclined distal surface that slopes downward toward the central bristle tuft; and wherein adjacent ones of the plurality of perimetric bristle tufts are separated by a space and the inner sidewalls of the plurality of perimetric bristle tufts are separated from the central bristle tuft by a gap, each of the spaces having a width in a circumferential angular direction about the central bristle tuft that is greater than a width of the gaps as measured in a radial direction from the central bristle tuft.

15. The oral care implement according to claim 14 wherein each of the plurality of perimetric bristle tufts comprise an outer surface sidewall, the outer sidewalls of the plurality of perimetric bristle tufts forming portions of an ellipse, the ellipse centered on the central bristle tuft.

16. The oral care implement according to claim 14 wherein the widths of the spaces are less than a width of each of the plurality of perimetric bristle tufts measured in a circumferential direction about the central bristle tuft, the widths of the spaces and the widths of the perimetric bristle tufts each measured at a radial distance from the central bristle tuft.

17. An oral care implement, comprising:

a head comprising a head portion and a head plate that is coupled to the head portion, the head plate having a first surface, a second surface opposite the first surface, and a plurality of tuft holes extending through the head plate;

a bristle tuft comprising a first portion that extends from the first surface of the head plate, a second portion that extends from the second surface of the head plate, and a third portion that is located within one of the tuft holes, the second portion being melted to form a melt matte to couple the bristle tuft to the head plate; and a plurality of perimetric bristle tufts extending from the first surface of the head, the plurality of perimetric bristle tufts comprising three rotationally symmetric pairs of bristle tufts, each of the rotationally symmetric pairs of bristle tufts having a different shape from a shape of each other rotationally symmetric pair of bristle tufts, the shapes of each of the rotationally symmetric pairs of bristle tufts being a different wedge-shape in plan view;

wherein the bristle tuft comprises a plurality of bristles that form a continuous wall that is free of gaps, the continuous wall surrounding a cavity having a frusto-conical shape.

18. The oral care implement according to claim 17 wherein each of the plurality of perimetric bristle tufts comprise an outer sidewall, the outer sidewalls of the plurality of perimetric bristle tufts forming portions of an ellipse, the ellipse centered on the bristle tuft.

19. The oral care implement according to claim 17 wherein adjacent ones of the plurality of perimetric bristle tufts are separated by a space, the space having a width measured in a circumferential direction about the bristle tuft which is less than a width of each of the plurality of perimetric bristle tufts measured in the circumferential direction about the bristle tuft.

* * * * *